US005878301A

United States Patent [19]

Katakura et al.

[11] Patent Number: 5,878,301

[45] Date of Patent: Mar. 2, 1999

[54] TONER IMAGE FIXING DEVICE WITH ROTATIONAL CONTROL OF FIXING ROLLERS

[75] Inventors: Shinichi Katakura; Noboru Otaki; Yoshiharu Momiyama; Hisao Ono; Makoto Yabuki, all of Tokyo, Japan

[73] Assignee: Oki Data Corporation, Tokyo, Japan

[21] Appl. No.: 964,674

[22] Filed: Nov. 5, 1997

[30] Foreign Application Priority Data

Nov. 14, 1996 [JP] Japan ..... 8-302889

[51] Int. Cl.[6] ..... G03G 15/20

[52] U.S. Cl. ..... 399/67; 399/331

[58] Field of Search ..... 399/70, 328, 330, 399/67, 69; 219/216

[56] References Cited

U.S. PATENT DOCUMENTS

| | | | |
|---|---|---|---|
| 4,081,213 | 3/1978 | Bar-on et al. | 399/325 |
| 5,111,249 | 5/1992 | Owada | 399/69 |
| 5,489,761 | 2/1996 | Aslam et al. | 219/216 |

FOREIGN PATENT DOCUMENTS 03-138681 6/1991 Japan .

05-241473 9/1993 Japan .

*Primary Examiner*—Robert Beatty

*Attorney, Agent, or Firm*—Panitch Schwarze Jacobs & Nadel, P.C.

[57] ABSTRACT

A toner image fixing device in an electrophotographic image forming apparatus has a heating roller containing a heater and a backup roller, a surface of which is in contact with a surface of the heating roller. A toner image on the paper is fixed by causing the paper to pass through a contacting portion of the heating roller and the backup roller. The toner image fixing device also has a driving device for supplying driving power to the heating roller or the backup roller to rotate both the heating roller and the backup roller, and a controller. The controller controls the driving section in such a way that both the heating roller and the backup roller begin to rotate intermittently immediately after an electric power supply switch of the apparatus is turned on and heat generation from the heater is initiated, and subsequently begin to rotate continuously when the backup roller achieves one revolution by the intermittent rotation. Alternatively, the rotation speed of the heating roller and backup roller is gradually and continuously increased immediately after electric power is initiated and subsequently reach a constant speed.

8 Claims, 11 Drawing Sheets

TONER IMAGE FIXING DEVICE WITH ROTATIONAL CONTROL OF FIXING ROLLERS

BACKGROUND OF THE INVENTION

The present invention relates to a toner image fixing device in an electrophotographic image forming apparatus such as an electrophotographic printer.

In conventional electrophotographic printers, an electrostatic latent image is formed by an LED head on a surface of a photosensitive drum which has been charged uniformly in advance, and the electrostatic latent image is developed into a toner image by a developing roller. Then, the toner image on the photosensitive drum is transferred to paper by a transfer roller, and the toner image is fixed on the paper by a toner image fixing device.

FIG. 1 is a schematic diagram showing a conventional toner image fixing device. As shown in FIG. 1, a toner image fixing device 57 includes a heating roller 17*a* which contains a heater 58, a backup roller 17*b*, a surface of which is in contact with a surface of the heating roller 17*a*, and a temperature sensor 60 which is in contact with the surface of the heating roller 17*a*.

The heating roller 17*a* and the backup roller 17*b* are kept at a set temperature by the heater 58 before the fixing process. When the paper 16 passes through a fixing position formed between the heating roller 17*a* and the backup roller 17*b*, toner 19 constituting the toner image is heated and pressed. As a result, the toner image is fixed on the paper 16.

When the electric power supply switch (not shown in FIG. 1) of the electrophotographic printer is turned on and the current begins to flow from the power source (not shown in FIG. 1) to the heater 58, temperature of the heating roller 17*a* and the backup roller 17*b* is still equal to ambient temperature. In the conventional printers, two methods to be described below have been used to raise the temperatures of the heating roller 17*a* and the backup roller 17*b* to a set temperature.

FIG. 2A is a diagram showing temperature curves of the heating roller when a first and a second conventional methods of raising the temperature of the heating roller 17*a* are adopted, FIG. 2B is a diagram showing maximum and minimum temperature curves of the backup roller when the first method is adopted, and FIG. 2C is a diagram showing maximum and minimum temperature curves of the backup roller when the second method is adopted. Further, FIG. 3 is a diagram showing surface temperature distribution of the backup roller when either the first or second method is adopted.

In FIGS. 2A, 2B and 2C, horizontal axes represent time. In FIG. 2A, a vertical axis represents a surface temperature of the heating roller 17*a*, and in FIGS. 2B and 2C, vertical axes represent a surface temperature of the backup roller 17*b*. In FIG. 3, a horizontal axis represents a position of the backup roller 17*b* in the circumferential direction, and a vertical axis represents a surface temperature of the backup roller 17*b*.

In FIG. 2A, a curve L1 indicates the surface temperature of the heating roller 17*a* in the first method, and a curve L2 indicates the surface temperature of the heating roller 17*a* in the second method. In FIG. 2B, a curve $L1_{MAX}$ and a curve $L1_{MIN}$ indicate the highest temperature and the lowest temperature on the backup roller 17*b*, respectively, in the first method. In FIG. 2C, a curve $L2_{MAX}$ and a curve $L2_{MIN}$ indicate the highest temperature and the lowest temperature on the backup roller 17*b*, respectively, in the second method. The maximum temperature curves $L1_{MAX}$ and $L2_{MAX}$ in FIGS. 2B and 2C represent the temperatures on a contacting portion $S_1$ (shown in FIG. 3) of the heating roller 17*a* and the backup roller 17*b*, while the minimum temperature curves $L1_{MIN}$ and $L2_{MIN}$ represent the temperatures at the location being farthest (180 degrees different in phase) away from the contacting portion $S_1$ on the circumference of the backup roller 17*b*.

In the first method, when the electric power supply switch of the electrophotographic printer is turned on and the current begins to flow into the heater 58, the heating roller 17*a* and the backup roller 17*b* are still not rotated. After that, when the temperature sensor 60 detects a set temperature $t_s$, the heating roller 17*a* and the backup roller 17*b* are rotated for a predetermined period of time, which is referred to as an equalizing time. This equalizing time is determined in such a way that the surface temperature distribution of the backup roller 17*b* is made uniform and the surface temperature of the backup roller 17*b* exceeds the set temperature.

In the second method, when the electric power supply switch of the electrophotographic printer is turned on and the current begins to flow into the heater 58, the heating roller 17*a* and the backup roller 17*b* are still not rotated. When the set time $T_1$ elapses, the heating roller and the backup roller 17*b* are rotated for a predetermined equalizing time.

In the above-mentioned conventional methods, the rotation speeds of the heating roller 17*a* and the backup roller 17*b* during the equalizing time are set to be identical to those during the printing operation of the electrophotographic printer.

In the above-mentioned conventional methods, however, the heating roller 17*a* and the backup roller 17*b* are not rotated until the temperature sensor 60 detects the set temperature $t_s$ or the set time $T_1$ elapses. For this reason, the temperature on the contacting portion $S_1$ alone on the circumference of the backup roller 17*b* rises abruptly, as shown in FIG. 3.

In order to prevent this, the heating roller 17*a* and the backup roller 17*b* are rotated at ordinary rotation speeds for the equalizing time, as described above. Nevertheless, a difference between the temperature on the contacting portion $S_1$ and the temperature on a portion other than the contacting portion $S_1$ remains for a long time, as shown in FIG. 3. For this reason, if the equalizing time is short, a variation in the surface temperature of the backup roller 17*b* in the circumferential direction is large, thus resulting in the degradation of the image quality. Moreover, since a difference between the temperature on the contacting portion $S_1$ and the temperature on the portion other than the contacting portion $S_1$ is great, the life of the backup roller 17*b* is shortened.

In contrast therewith, if the equalizing time is long, the surface temperature of the backup roller 17*b* in the circumferential direction becomes rather uniform. However, it takes a longer time for the electrophotographic printer to be started up.

The method of initiating the rotation of the heating roller 17*a* and the backup roller 17*b* at a constant speed immediately after the electric power supply switch of the electrophotographic printer is turned on and the current flows into the heater 58 may also be conceived. In this method, however, heat diffusion from the heating roller 17*a* to the backup roller 17*b* increases, so that it takes a longer time to raise the surface temperature of the heating roller 17*a* to the set temperature. Accordingly, it also takes a longer time for the electrophotographic printer to finish a starting-up operation required before the fixing process.

SUMMARY OF THE INVENTION

It is therefore an object of the present invention to provide a toner image fixing device capable of improving image quality, reducing time required for starting up an electrophotographic printer, and extending a life of a backup roller.

According to one aspect of the invention, a toner image fixing device in an electrophotographic image forming apparatus comprises: a heating roller containing a heat generating source; a backup roller, a surface of which is in contact with a surface of the heating roller. A toner image on the paper is fixed by causing the paper to pass through a contacting portion of the heating roller and the backup roller. The toner image fixing device also comprises: a driving device for supplying driving power to at least one of the heating roller and the backup roller to rotate both the heating roller and the backup roller; and a controller for controlling the driving device in such a way that both the heating roller and the backup roller begin to rotate intermittently immediately after an electric power supply switch of the electrophotographic image forming apparatus is turned on and heat generation from the heat generating source is initiated, and subsequently rotate continuously.

The intermittent rotation of the heating roller and the backup roller is performed in such a way that the backup roller is rotated by a predetermined set angle at intervals of a predetermined set time repeatedly, and the continuous rotation of the heating roller and the backup roller is begun when the backup roller achieves one revolution by the intermittent rotation. Further, the predetermined set time may be gradually shortened as the heating roller and the backup roller are intermittently rotated.

According to another aspect of the present invention, a toner image fixing device in an electrophotographic image forming apparatus comprises: a heating roller containing a heat generating source; and a backup roller, a surface of which is in contact with a surface of the heating roller. A toner image on the paper is fixed by causing the paper to pass through a contacting portion of the heating roller and the backup roller. The toner image fixing device also comprises: a driving device for supplying driving power to at least one of the heating roller and the backup roller to rotate both the heating roller and the backup roller; and a controller for controlling the driving device in such a way that both the heating roller and the backup roller repeat reciprocating rotation intermittently immediately after an electric power supply switch of the electrophotographic image forming apparatus is turned on and heat generation from the heat generating source is initiated.

The reciprocating rotation of the heating roller and the backup roller is performed in such a way that the heating roller repeats reciprocating rotation by a predetermined set angle which is equal to or less than half revolution until the surface temperature detected by a temperature sensor reaches a predetermined set temperature during the reciprocating rotation of the heating roller and the backup roller.

Further, it is desirable that an outside diameter of the backup roller is smaller than an outside diameter of the heating roller.

According to another aspect of the present invention, a toner image fixing device in an electrophotographic image forming apparatus comprises: a heating roller containing a heat generating source; and a backup roller, a surface of which is in contact with a surface of the heating roller. A toner image on the paper is fixed by causing the paper to pass through a contacting portion of the heating roller and the backup roller. The toner image fixing device also comprises: a driving device for supplying driving power to at least one of the heating roller and the backup roller to rotate both the heating roller and the backup roller; and a controller for controlling the driving device in such a way that both the heating roller and the backup roller begin to rotate continuously immediately after an electric power supply switch of the electrophotographic image forming apparatus is turned on and heat generation from the heat generating source is initiated; wherein a rotation speed of the heating roller and the backup roller is gradually and continuously increased, and subsequently reaches a predetermined constant speed.

The rotation at the predetermined constant speed is begun when the backup roller achieves one revolution.

BRIEF DESCRIPTION OF THE DRAWINGS

The present invention will become more fully understood from the detailed description given hereinbelow and the accompanying drawings which are given by way of illustration only, and wherein.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

First Embodiment

Figure 4:
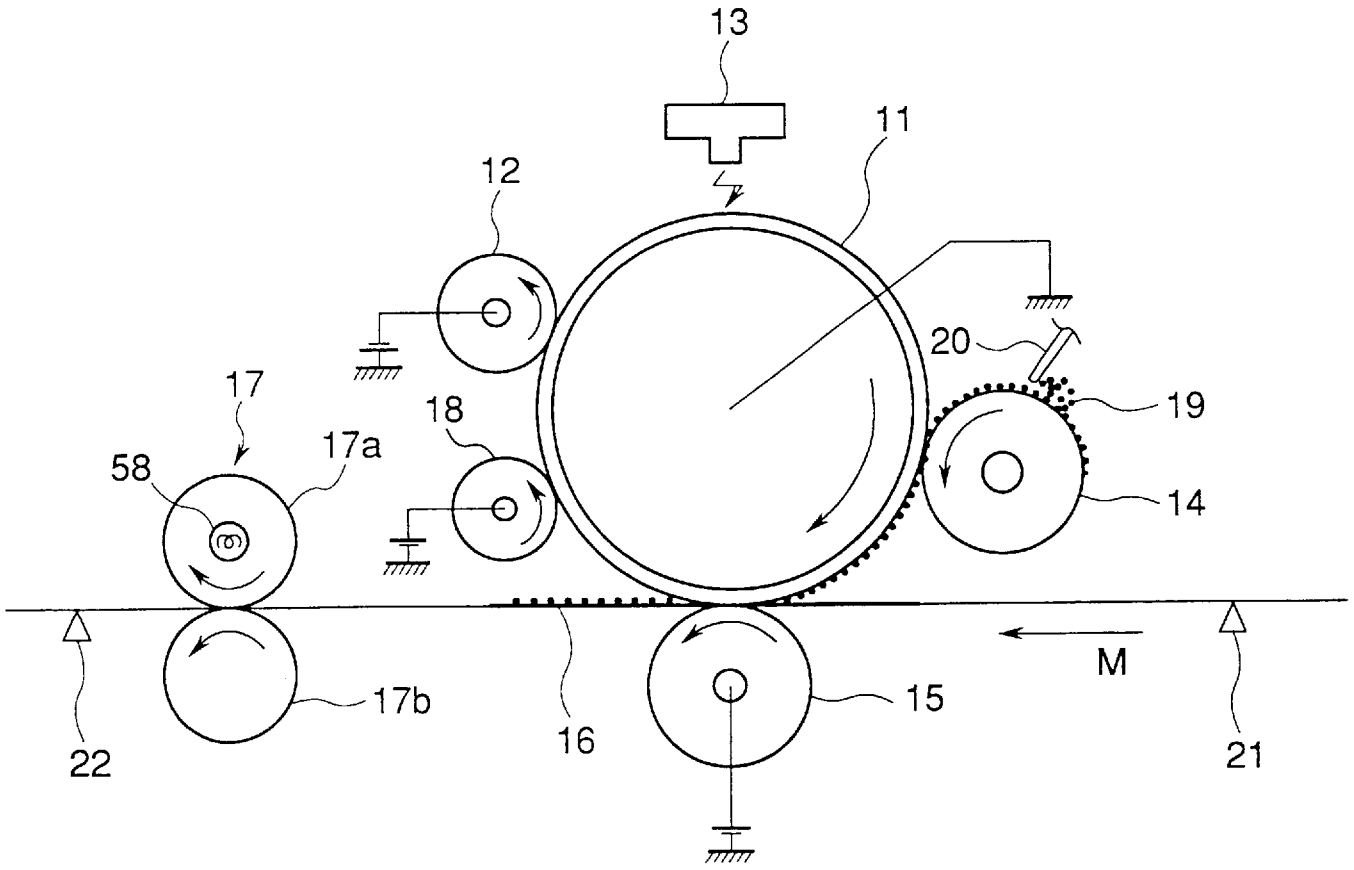
FIG. 4 is a schematic diagram showing an electrophotographic printer incorporating a toner image fixing device according a first embodiment of the present invention.
Figure 5:
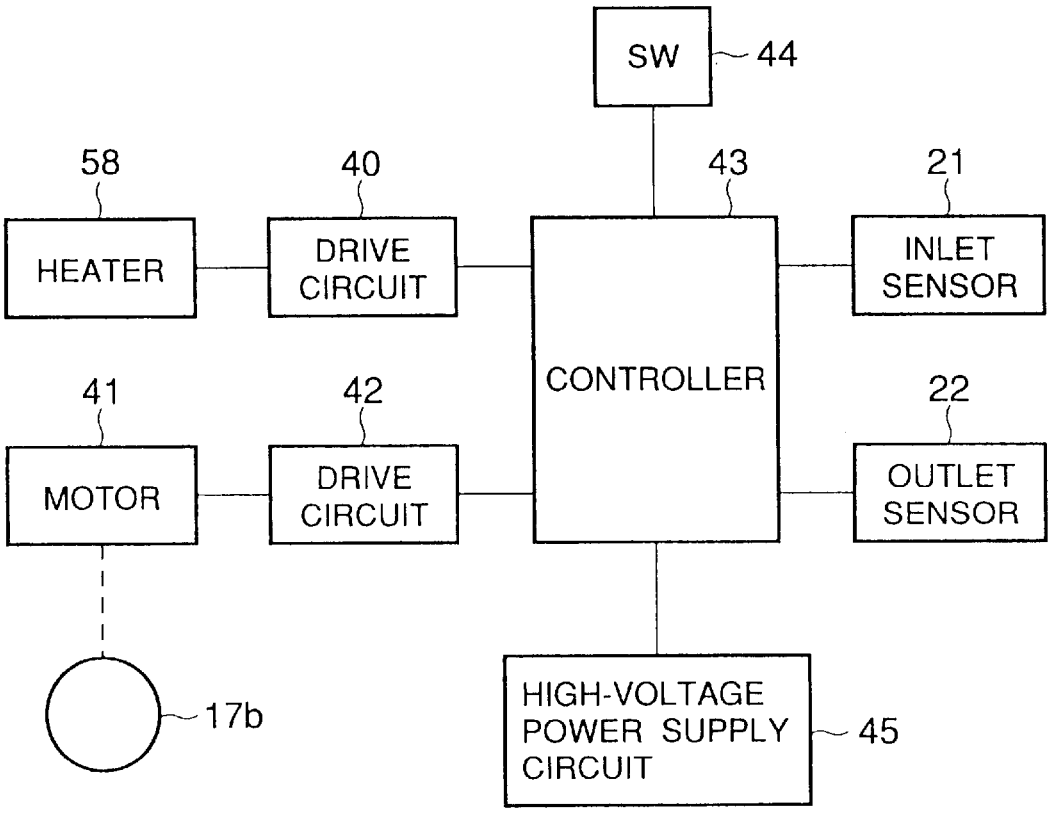
FIG. 5 is a block diagram showing the toner image fixing device of the first embodiment.
Figure 6:
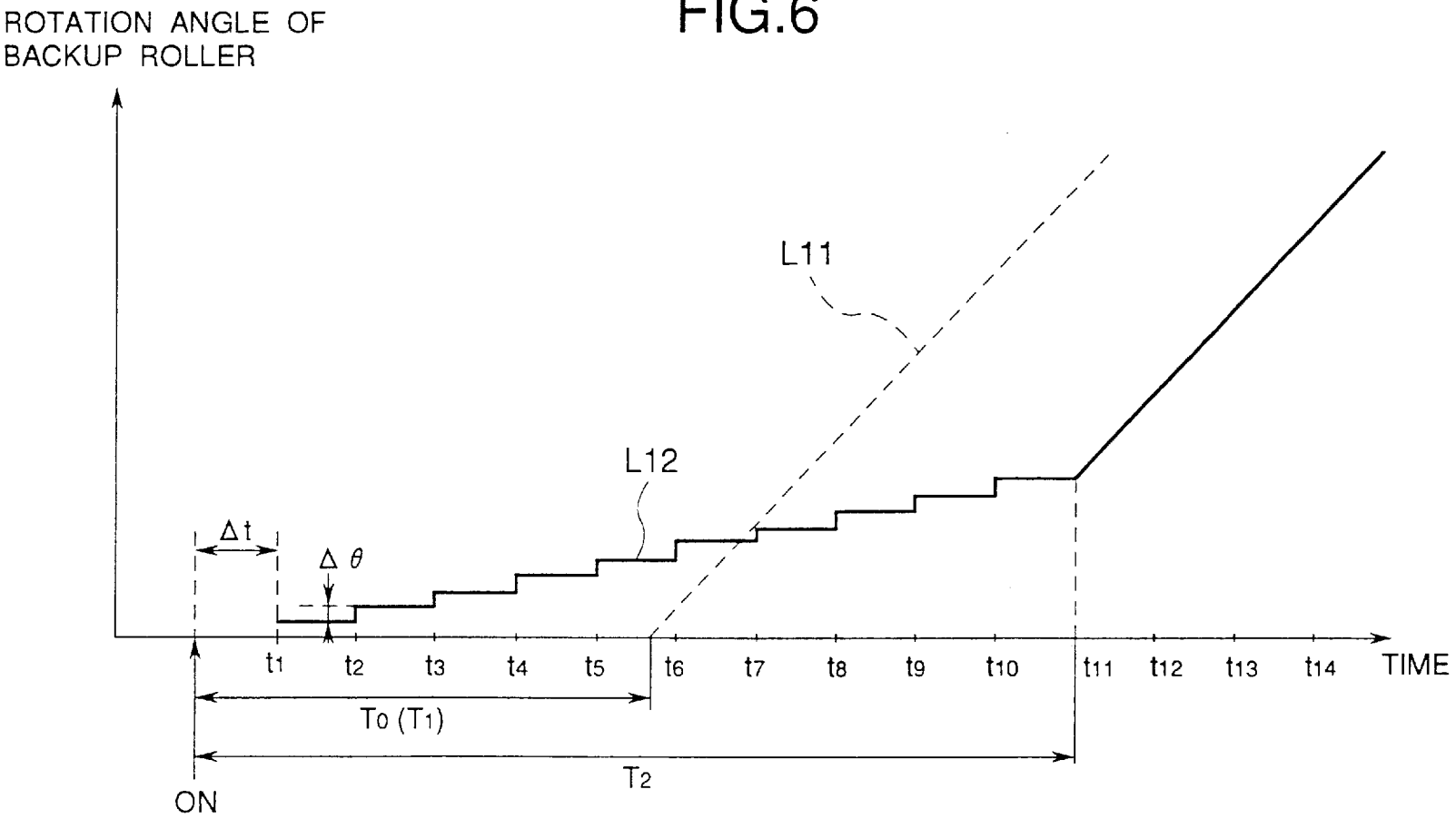
FIG. 6 is a diagram showing a relationship between time and a rotation angle of the backup roller according to the first embodiment.
Figure 7:
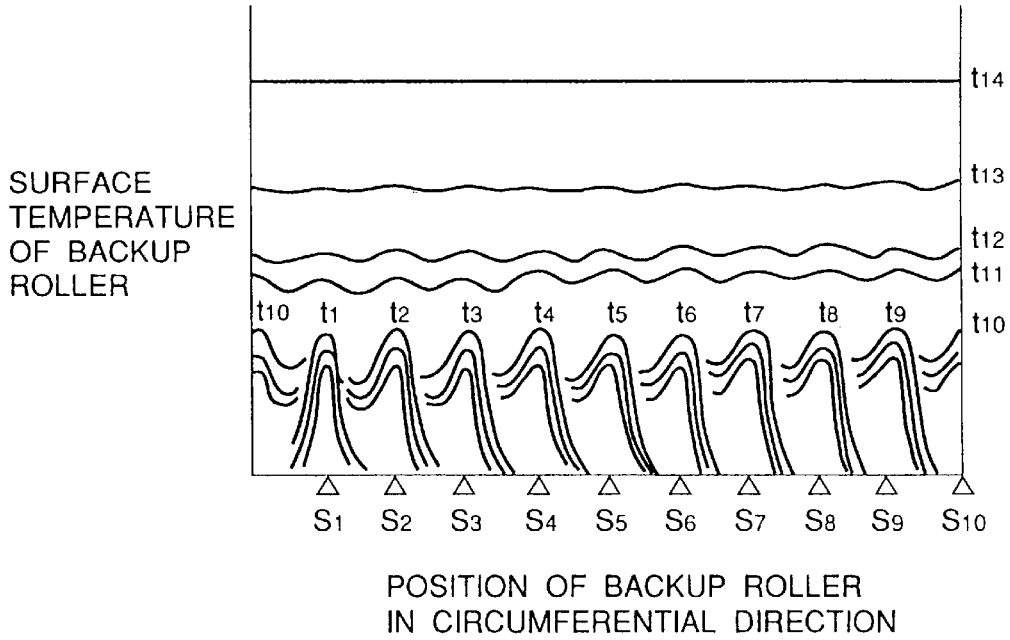
FIG. 7 is a diagram showing surface temperature distribution of the backup roller according to the first embodiment.

FIG. 4 is a schematic diagram showing an electrophotographic printer as an electrophotographic image forming apparatus incorporating the toner image fixing device according a first embodiment of the present invention, and FIG. 5 is a block diagram showing the toner image fixing device of the first embodiment. Further, FIG. 6 is a diagram showing a relationship between time and a rotation angle of a backup roller in the toner image fixing device of the first embodiment, and FIG. 7 is a diagram showing surface temperature distribution of the backup roller in the toner image fixing device of the first embodiment. In FIG. 6, a horizontal axis represents time, while a vertical axis represents a rotation angle of a backup roller 17*b*. In FIG. 7, a horizontal axis represents a position of the backup roller 17*b* in the circumferential direction and a vertical axis represents the surface temperature of the backup roller 17*b*.

Referring to FIG. 4, the electrophotographic printer includes a photosensitive drum 11, a charging roller 12 for charging a surface of the photosensitive drum 11 uniformly, an LED head 13 for applying light beams on the surface of the photosensitive drum 11 to form an electrostatic latent image on the photosensitive drum 11, a developing roller 14 for developing the electrostatic latent image on the photosensitive drum 11 into a toner image, and a transfer roller 15 for transferring the toner image onto paper 16. A developing section is formed between the developing roller 14 and the photosensitive drum 11, and a transfer section is formed between the transfer roller 15 and the photosensitive drum 11.

The electrophotographic printer further includes a toner image fixing device 17 according to the first embodiment for fixing the transferred toner image on the paper 16, a cleaning roller 18, a developing blade 20, an inlet sensor 21 disposed in a paper transport path in the upstream of the transfer section, and an outlet sensor 22 disposed in the paper transport path in the downstream of the toner image fixing device 17.

Referring to FIG. 4, the toner image fixing device 17 has a heating roller 17*a* which contains a heater 58 as a heat generating source, and a backup roller 17*b* rotatably disposed in contact with the heating roller 17*a*.

Referring to FIG. 5, the toner image fixing device 17 has a drive circuit 40 for driving the heater 58, a motor 41 for supplying driving power to the backup roller 17*b*, thereby rotating the backup roller 17*b* and the heating roller 17*a*, a drive circuit 42 for driving the motor 41, and a controller 43. The controller 43 controls an operation of the motor 41 and the heater 58 in such a way that the backup roller 17*b* and the heating roller 17*a* begin to rotate intermittently immediately after a electric power supply switch 44 of the electrophotographic printer is turned on and heat generation from the heater 58 is initiated, and subsequently rotate continuously. Further, the motor 41 may supply driving power to the heating roller 17*a* in place of the backup roller 17*b*.

In the electrophotographic printer of FIG. 4, the photosensitive drum 11, the charging roller 12, the developing roller 14, the transfer roller 15, the toner image fixing device 17, and the cleaning roller 18 are rotated in the directions of arrows shown in this figure, respectively. When the light emitting diodes (not shown) in the LED head 13 emit light selectively, an electrostatic latent image is formed on the photosensitive drum 11 which has been charged uniformly by the charging roller 12 in advance. Then toner 19 is attached to the surface of the photosensitive drum 11 from the developing roller 14 to develop the electrostatic latent image into a toner image.

On the other hand, when the paper 16 fed in the direction of an arrow M from a paper cassette (not shown) is passed through the transfer section, the toner image on the photosensitive drum 11 is transferred onto the paper 16 by the transfer roller 15. Then, the transferred toner image is fixed by the toner image fixing device 17. A small amount of the toner 19 which remains on the photosensitive drum 11 after the transfer is removed by the cleaning roller 18.

When the paper 16 fed from the paper cassette is detected by the inlet sensor 21, a detection signal from the inlet sensor 21 is supplied to the controller 43 (shown in FIG. 5), and a high-voltage power supply circuit 45 (shown in FIG. 5) is operated by the controller 43, and a high voltage is applied to the photosensitive drum 11, the charging roller 12, the developing roller 14, the transfer roller 15, the cleaning roller 18, and other components, respectively. Then, the photosensitive drum 11, the charging roller 12, the LED head 13, the developing roller 14, the transfer roller 15, the cleaning roller 18, and other components are operated on the basis of the transport speed of the paper 16 and a distance between the inlet sensor 21 and the transfer section. When the paper 16 with the toner image fixed thereon is detected by the outlet sensor 22, a detection signal from the outlet sensor 22 is supplied to the controller 43, and the operation of the high-voltage power supply circuit 45 is stopped.

Further, as has been described, either of the heating roller 17*a* and the backup roller 17*b* in the toner image fixing device 17 is coupled to the motor 41 via gears (not shown) and by driving the motor 41, and the heating roller 17*a* and the backup roller 17*b* can be rotated.

Next, a change in the rotation angle of the backup roller 17*b* during the starting-up operation of the electrophotographic printer.

Figure 2A:
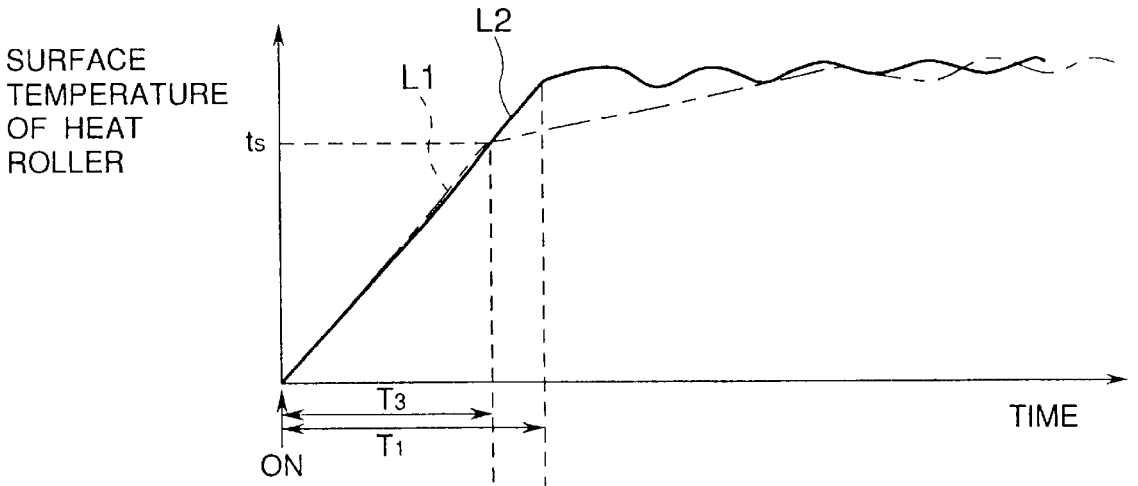
FIG.2A CONVENTIONAL ART
FIG. 2A is a diagram showing temperature curves of the heat roller when a first and a second conventional methods of raising the temperature of the heating roller 17*a* are adopted.
Figure 2B:
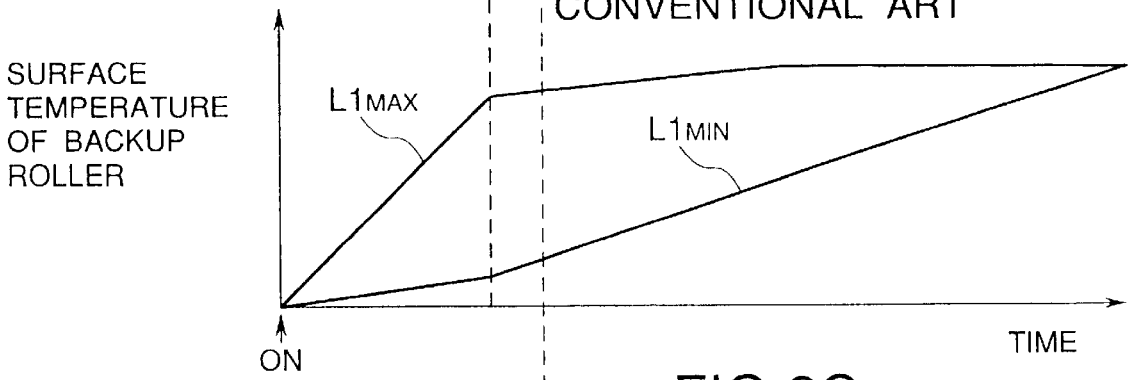
FIG.2B CONVENTIONAL ART
FIG. 2B is a diagram showing maximum and minimum temperature curves of the backup roller when the first conventional method is adopted.
Figure 2C:
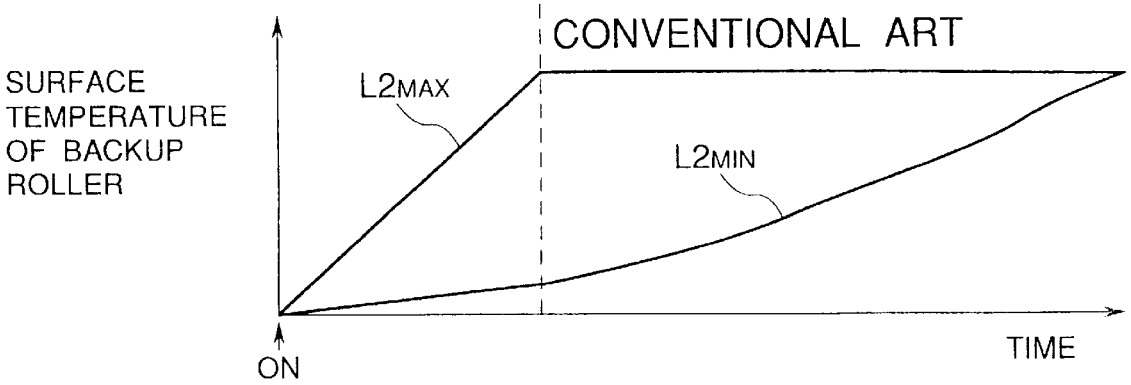
FIG.2C CONVENTIONAL ART
FIG. 2C is a diagram showing maximum and minimum temperature curves of the backup roller when the second conventional method is adopted.
Figure 3:
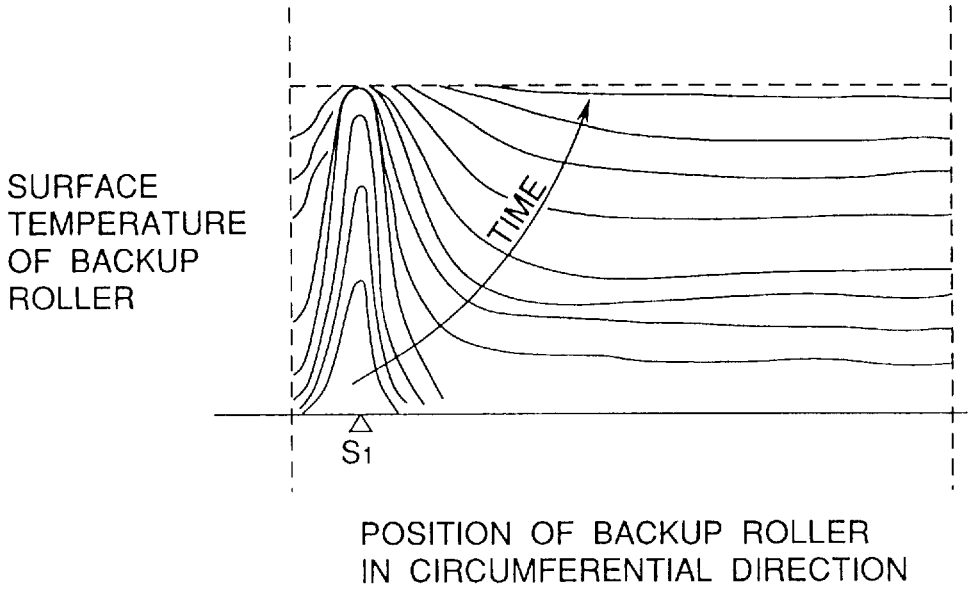
FIG.3 CONVENTIONAL ART
FIG. 3 is a diagram showing surface temperature distribution of the backup roller when either the first or second conventional method is adopted.

Referring to FIG. 6, a curve L11 indicates the rotation angle of the backup roller 17*b* in the conventional method shown in FIG. 2A. A curve L12 indicates the rotation angle of the backup roller 17*b* in the toner image fixing device of the first embodiment. As shown in FIG. 2A, it takes a time $T_3$ for the temperature sensor 60 to detect the set temperature $t_s$ (refer to FIG. 2A) in the first conventional method of starting up the electrophotographic printer. The set time $T_1$ is used in the second conventional method of starting up the electrophotographic printer. It takes a time $T_2$ for the backup roller 17*b* to achieve one revolution in the toner image fixing device of the present invention.

In the case of the toner image fixing device of the first embodiment, when the electric power supply switch 44 of the electrophotographic printer is turned on and the current begins to flow into the heater 58, the controller controls the motor 41 so as to rotate the backup roller 17*b* just by a set angle $\Delta\theta$ at intervals of a predetermined set time $\Delta t$ repeatedly. As a result, the rotation angle of the backup roller 17*b* is increased as seen from the curve L12 in FIG. 6. In other words, after the electric power supply switch 44 of the electrophotographic printer is turned on and the set time $\Delta t$ elapses, the backup roller 17*b* is rotated by the set angle $\Delta\theta$ at each of timings $t_1$–$t_{10}$. Then, after one revolution of the backup roller 17*b* is achieved at timing $t_{11}$, the backup roller 17*b* is rotated continuously.

As a result, the surface temperature of the backup roller 17*b* first reaches its peak on the contacting portion $S_1$ at the timing $t_1$,as shown in FIG. 7. Then, the contacting portion $S_1$ is shifted with the rotation of the backup roller 17*b* at each of the timings $t_2$–$t_{10}$. In addition to the initial contacting portion $S_1$, nine contacting portions $S_2$–$S_{10}$ are formed with the rotation of the backup roller 17*b*, and the surface temperatures of the backup roller 17*b* reach their peaks on the respective contacting portions $S_2$–$S_{10}$. Then, when the continuous rotation of the backup roller 17*b* is initiated at the timing $t_{11}$, the surface temperature curve of the backup roller 17*b* becomes smoother at each of the timings $t_{11}$–$t_{13}$, and finally becomes constant at timing $t_{14}$.

The set time $\Delta t$ and the set angle $\Delta\theta$ are determined on the basis of the peak temperatures and the temperature gradients in the areas adjacent to the contacting portions $S_1$–$S_{10}$.

In this way, the backup roller 17*b* is rotated by the set angle $\Delta\theta$ at intervals of a predetermined set time $\Delta t$, and the surface temperatures of a plurality of locations in the circumferential direction of the backup roller 17*b* reach their peaks. Then, after one revolution of the backup roller 17*b* is achieved in this way, the continuous rotation of the backup roller 17*b* is initiated and the peak temperatures are leveled off. Accordingly, even in the first print produced after the electrophotographic printer is started up, a variation in the surface temperature in the circumferential direction of the backup roller 17*b* can be prevented, and the image quality thus can be improved.

Further, since a plurality of the contacting portions $S_1$–$S_{10}$ are formed, a difference between the temperature on the respective contacting portions $S_1$–$S_{10}$ and the temperature on a portion other than the contacting portions $S_1$–$S_{10}$ is reduced. Thus, the life of the backup roller 17*b* can be extended.

Figure 8:
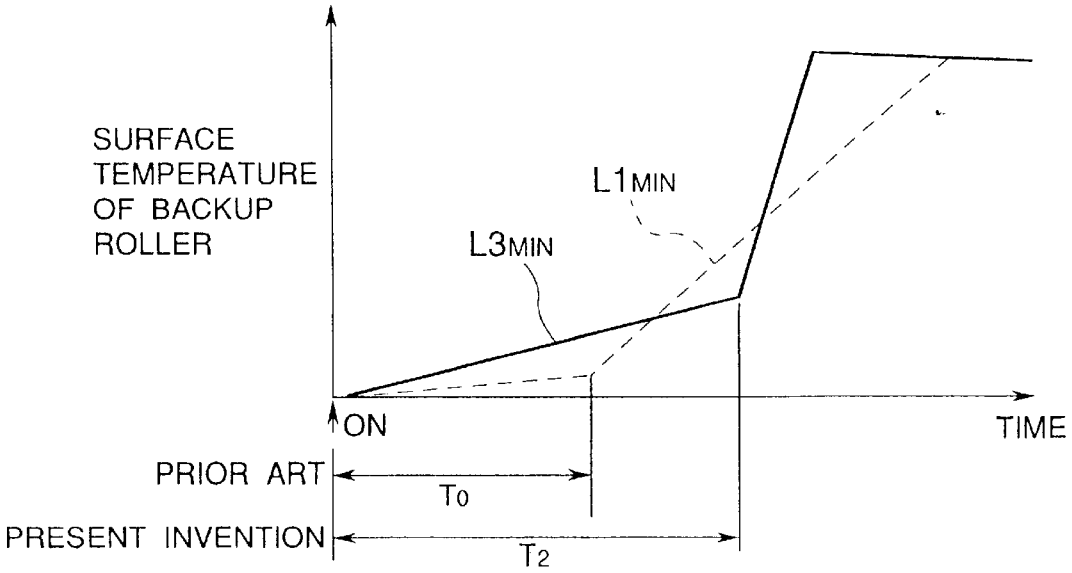
FIG. 8 is a diagram showing the surface temperature curves of the backup roller in the toner image fixing device according to the first embodiment and the conventional toner image fixing device.

FIG. 8 is a diagram showing surface temperatures of the backup roller in the above-mentioned first embodiment and the conventional device.

Figure 1:
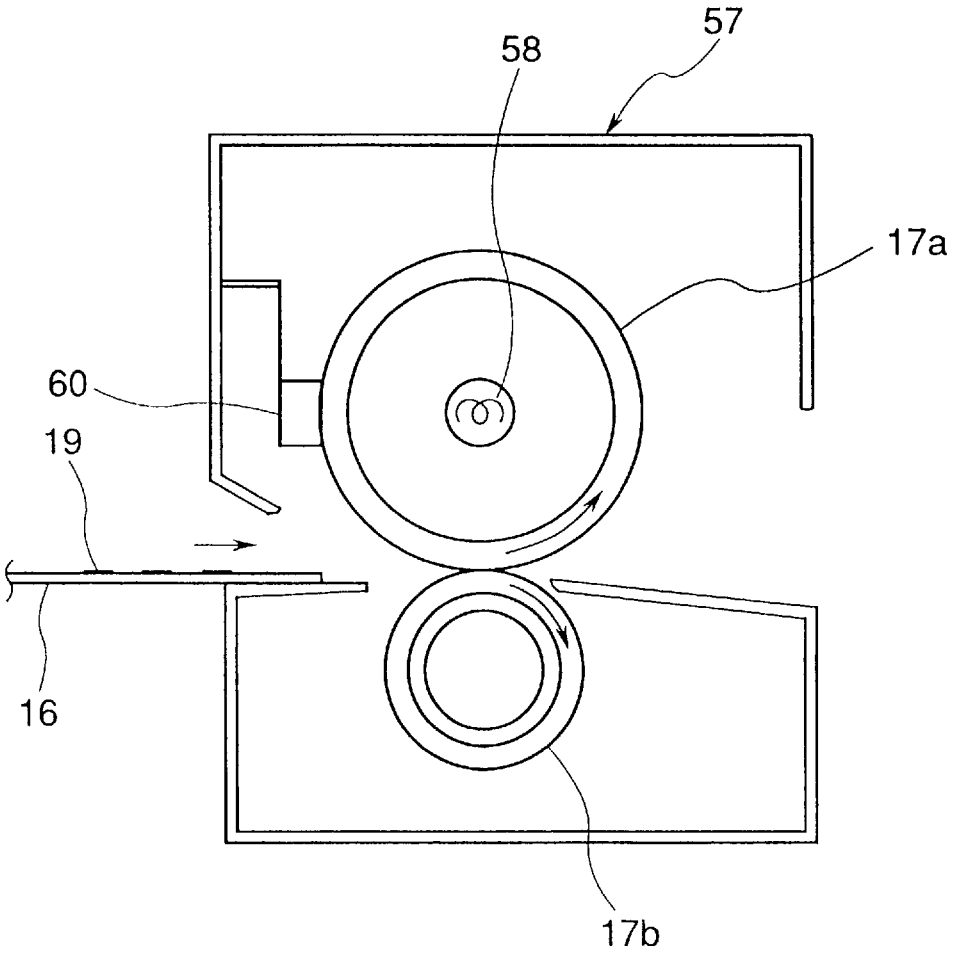
FIG.1 CONVENTIONAL ART
FIG. 1 is a schematic diagram showing a conventional toner image fixing device.

In FIG. 8, the curve $L1_{MIN}$ indicates the lowest temperature on the backup roller 17*b* (refer to FIG. 1) in the conventional device, and a curve $L3_{MIN}$ indicates the lowest temperature on the backup roller 17*b* (in FIG. 5) in the first embodiment. It takes the time $T_3$ for the temperature sensor 60 to detect the set temperature $t_s$ (refer to FIG. 2A) in the conventional device, and it takes the time $T_2$ for the backup roller 17*b* to achieve one revolution in another conventional device.

As seen from FIG. 8, in the conventional electrophotographic printer, the backup roller 17*b* is not operated until the time $T_3$ elapses. Thus, the temperature at the location that is farthest away from the contacting portion $S_1$ (in FIG. 6) is increased gradually since the heat from the contacting portion $S_1$ is to be transmitted through the backup roller 17*b*.

In contrast therewith, in the first embodiment, the backup roller 17*b* is rotated intermittently until the time $T_2$ elapses. Thus, the temperature at the location that is farthest away from the initial contacting portion $S_1$ on the circumference is increased comparatively soon, since not only the heat from the contacting portion $S_1$ is to be transmitted through the backup roller 17*b* but also the contacting portion $S_1$ is to be shifted closer to the location that is farthest away from the initial contacting portion $S_1$ with the rotation of the backup roller 17*b*.

For this reason, the gradient of the curve $L3_{MIN}$ indicating the lowest temperature on the backup roller 17*b* in the first embodiment is larger than that of the curve $L1_{MIN}$ indicating the lowest temperature on the backup roller 17*b* in the conventional electrophotographic printer. A variation in the surface temperature in the circumferential direction of the backup roller 17*b* thus can be prevented correspondingly, and the image quality thus can be improved.

Second Embodiment

Figure 9:
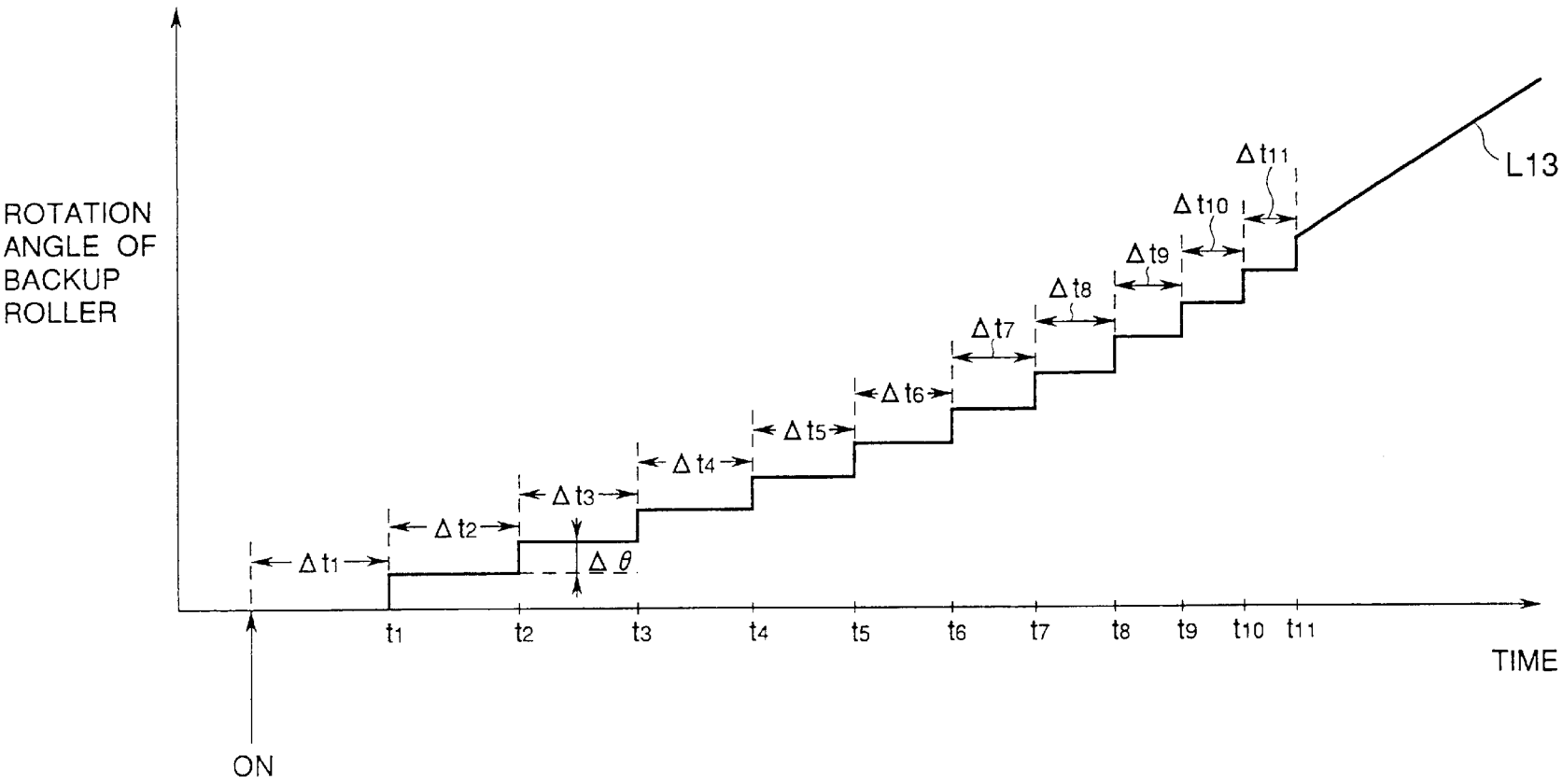
FIG. 9 is a diagram showing a relationship between time and a rotation angle of the backup roller according to a second embodiment of the present invention.
Figure 10:
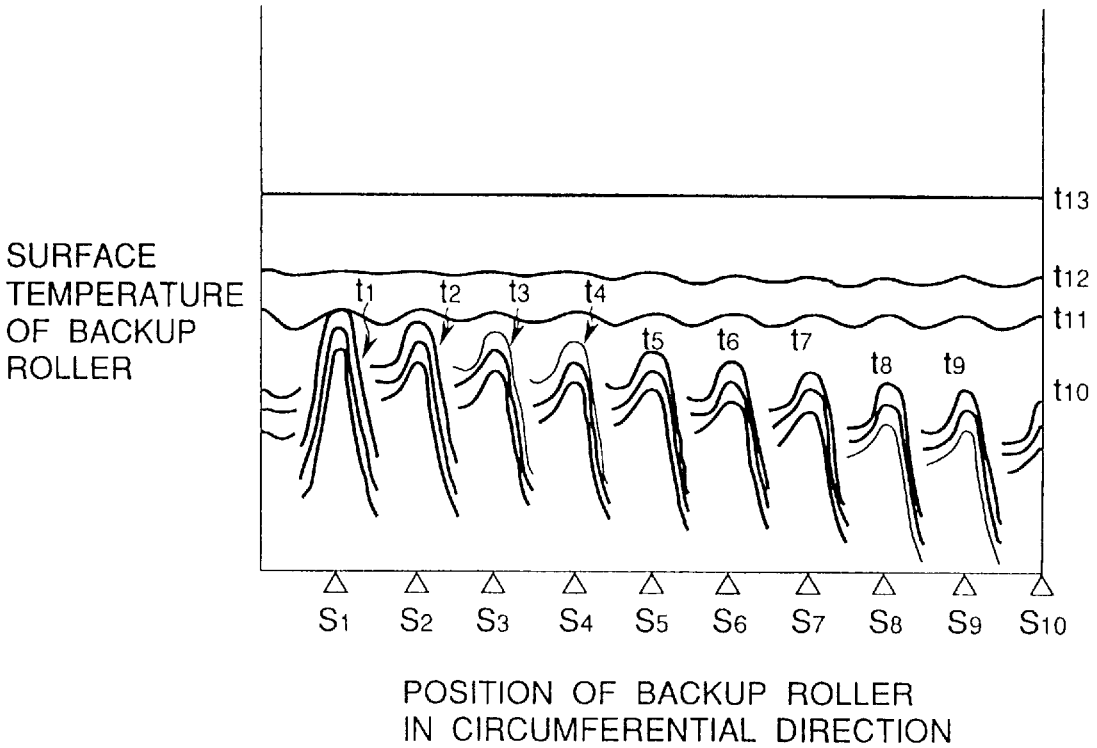
FIG. 10 is a diagram showing surface temperature distribution of the backup roller according to the second embodiment.

FIG. 9 is a diagram showing a relationship between time and a rotation angle of the backup roller according to a second embodiment of the present invention, and FIG. 10 is a diagram showing surface temperature distribution of the backup roller according to the second embodiment.

A toner image fixing device in an electrophotographic printer according to the second embodiment is the same as that according to the first embodiment except for timings of rotating the backup roller after the electric power supply switch of the electrophotographic printer is turned on. Therefore, a reference is made to FIG. 5 in the following description.

When the electric power supply switch 44 of the electrophotographic printer is turned on and the current begins to flow into the heater 58 (ON in FIG. 9), the controller 43 controls the drive circuits 40 and 42 in such a way that the backup roller 17*b* is rotated by the set angle $\Delta\theta$ at each timing $t_1$ to $t_{11}$. The intervals $\Delta t_1$ to $t_{11}$ between the adjacent timings are set to be decreased gradually, satisfying a relation of $\Delta t_{n-1}>\Delta t_n$, where n denotes an integer not less than 1. As a result, the backup roller 17*b* is rotated intermittently while its drive intervals are reduced progressively, and the rotation angle of the backup roller 17*b* is shown as the curve L13 in FIG. 9. In the second embodiment, after the electric power supply switch of the electrophotographic printer is turned on, the backup roller 17*b* is rotated by the set angle $\Delta\theta$ at each of timings $t_1$ to $t_{10}$ at intervals of the set time $\Delta t_1$ to $\Delta t_{11}$, respectively. Then, when one revolution of the backup roller 17*b* is achieved, the backup roller 17*b* begins to rotate continuously.

Consequently, as shown in FIG. 10, the surface temperature of the contacting portion $S_1$ on the circumference of the backup roller 17*b* first reaches its peak at the timing $t_1$. Then, the contacting portion $S_1$ is shifted at each of the timings $t_2$ to $t_{11}$ with the rotation of the backup roller 17*b*, and the surface temperatures of the contacting portions $S_2$ to $S_{10}$ reach their peaks at the timings $t_2$ to $t_{10}$, respectively. During that time, since the set times $\Delta t_1$ to $\Delta t_{11}$ satisfy the relation of $\Delta t_{n-1}>\Delta t_n$, the peak temperatures are decreased progressively. Then, when the continuous rotation of the backup roller 17*b* is initiated at the timing $t_{11}$, the surface temperature curve of the backup roller 17*b* becomes smoother at each of the timings $t_{11}$ and $t_{12}$, and becomes constant at the timing $t_{13}$.

The set times $\Delta t_1$ to $\Delta t_{11}$ and the set angle $\Delta\theta$ are set on the basis of the peak temperatures, the temperature gradients in the areas adjacent to the contacting portions $S_1$ to $S_{10}$, the rate of heat dissipation, and heat conduction from the contacting portions.

By reducing the set times $\Delta t_1$ to $\Delta t_{11}$ progressively in view of the heat dissipation from the contacting portions $S_1$ to $S_{10}$ and the heat conduction from other contacting portions in this way in the second embodiment, the temperature distribution in the circumferential direction of the backup roller after one revolution thereof becomes more uniform. The period of the starting up time thus can be reduced.

Third Embodiment

Figure 11:
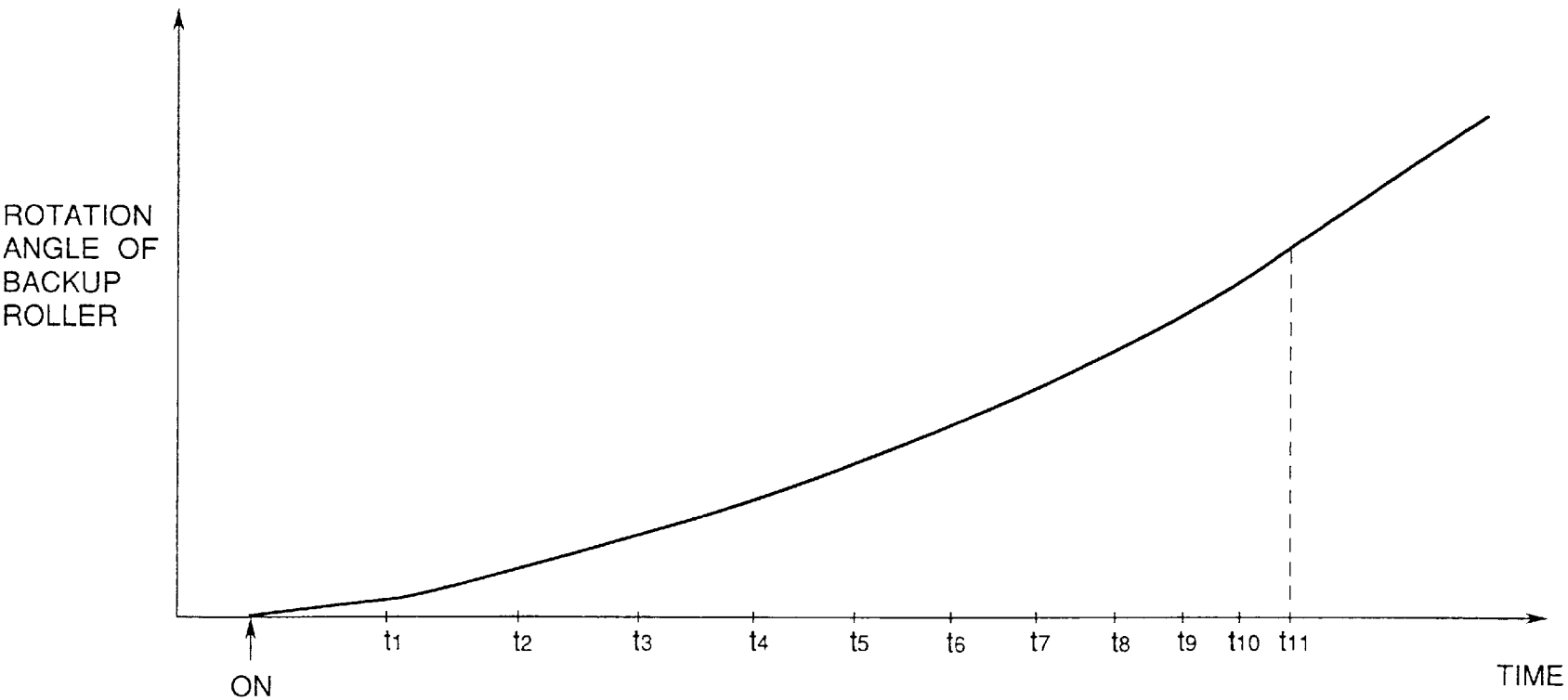
FIG. 11 is a diagram showing a relationship between time and a rotation angle of the backup roller according to a third embodiment of the present invention.

FIG. 11 is a diagram showing a relationship between time and a rotation angle of the backup roller according to a third embodiment of the present invention.

The toner image fixing device according to the third embodiment is the same as that according to the first embodiment except for a control method of rotating the backup roller 17*b* after the electric power supply switch of the electrophotographic printer is turned on. Therefore, a reference is made to FIG. 5 in the following description.

When the electric power supply switch 44 of the electrophotographic printer is turned on and the current begins to flow into the heater 58, the controller 43 controls the drive circuits 40 and 42 in such a way that the backup roller 17*b* is rotated continuously at a low speed, then to gradually accelerate the rotation up to a certain speed (speed of rotation during the printing operation) until the surface temperature of the backup roller reaches a predetermined temperature.

In the third embodiment, since the rotation sound of the motor 41 to be generated when driving the motor 41 intermittently as in the first embodiment is not produced, noise prevention can be achieved.

Fourth Embodiment

Figure 12:
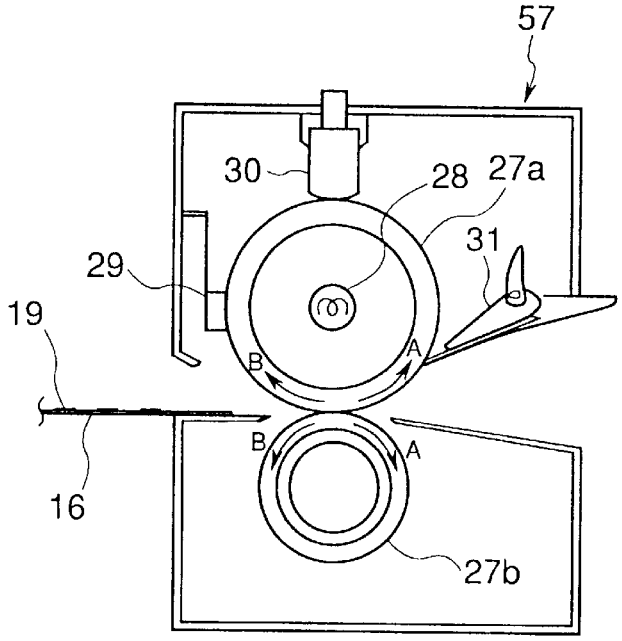
FIG. 12 is a schematic diagram showing a toner image fixing device in an electrophotographic printer according to a fourth embodiment of the present invention.
Figure 13:
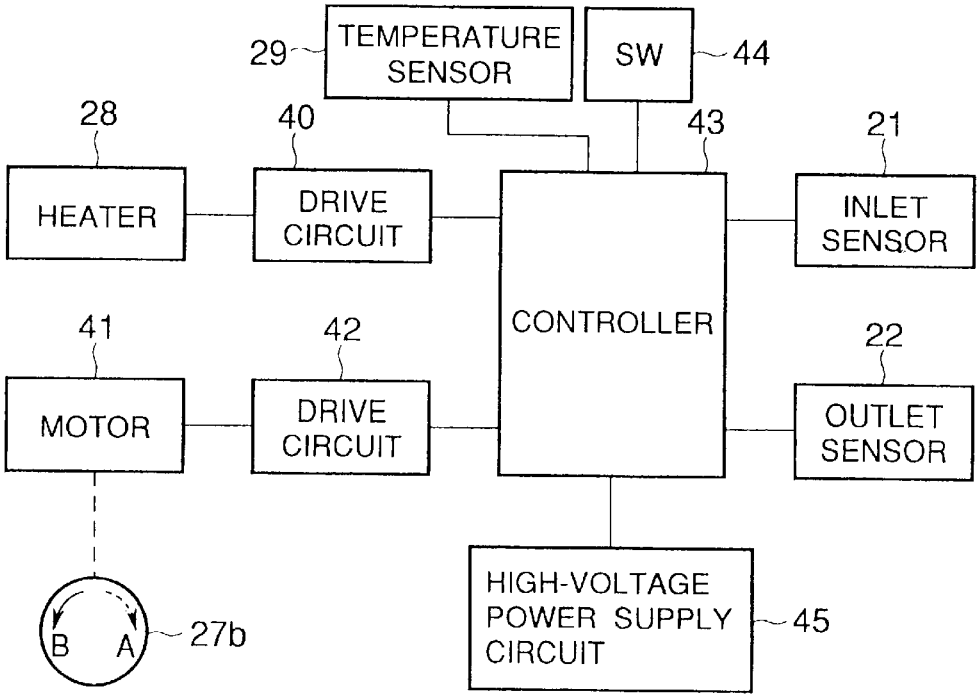
FIG. 13 is a block diagram showing the toner image fixing device of the fourth embodiment.

FIG. 12 is a schematic diagram showing a toner image fixing device in an electrophotographic printer according to a fourth embodiment of the present invention, and FIG. 13 is a block diagram showing the toner image fixing device of the fourth embodiment. Those structures in FIG. 13 that are identical to or correspond to structures in FIG. 5 are assigned identical symbols.

Referring to FIG. 12, the toner image fixing device of the fourth embodiment includes a heating roller 27*a* containing a heater 28 such as a halogen lamp and a backup roller 27*b*, a surface of which is in contact with a surface of the heating roller 27*a*. An outside diameter of the backup roller 27*b* is set to be smaller than that of the heating roller 27*a*. The heating roller 27*a* has a cylindrical core made from, for example, aluminum, and a coating such as a fluororesin coating provided on a surface of the core. The backup roller 27*b* has a cylindrical core made from, for example, aluminum, and a resin coating of a silicone rubber group provided on a surface of the core. The paper 16 having the toner 19 passes through a contacting portion of the backup roller 27*b* and the heating roller 27*a*, thereby fixing the toner 19 on the paper 16.

The toner image fixing device of the fourth embodiment also includes a temperature sensor 29 such as a thermistor which is disposed in contact with the heating roller 27*a* and detects the surface temperature of the heating roller 27*a*, and an oil pad 30 which is disposed in contact with the heating roller 27*a* and absorbs offset prevention liquid. The oil pad 30 applies the offset prevention liquid to the surface of the heating roller 27*a* so as to remove toner 19 adhered to the surface of the heating roller 27*a* as well as to prevent the toner 19 from being attached to the surface of the heating roller 27*a*. Further, the toner image fixing device of the fourth embodiment includes a separating member 31 for separating the paper 16 from the heating roller 27*a*.

Referring to FIG. 13, the backup roller 27*b* is connected to a motor 41 via, for example, gears (not shown). The backup roller 27*b* and the heating roller 27*a* being in contact with it can therefore be rotated in the directions A and B. Although the backup roller 17*b* is connected to the motor 41 in FIG. 13, in place of the backup roller 41, the heating roller 27*a* may be connected to the motor 41 via, for example, gears.

Next, the operation of the toner image fixing device 27 having the above mentioned structures will be described.

First, when the electric power supply switch 44 of the electrophotographic printer is turned on and the heat generation form the heater 28 is initiated, a starting-up operation of the electrophotographic printer is performed until the surface temperature of the heating roller 27*a* reaches a predetermined set temperature. In the starting-up operation, immediately after the heat generation from the heater 28 is initiated, the controller 43 controls the drive circuit 42 for the motor 41 in such a way that the backup roller 27*a* and the heating roller 27*a* rotate in the direction A. The rotation speed at that time is set to be smaller than that used for fixing the toner image on the paper 16.

Then, before the heating roller 27*a* makes a half revolution, the controller 43 controls the drive circuit 42 for the motor 41 in such a way that the backup roller 27*b* and the heating roller 27*a* rotate in the direction B. Thereafter, before the heating roller 27*a* makes a half revolution, the controller 43 controls the drive circuit 42 for the motor 41 in such a way that the backup roller 27*b* and the heating roller 27*a* rotate in the direction A. In this way, the backup roller 27*b* and the heating roller 27*a* are made to repeat reciprocating rotation both in the directions A and B.

When some amount of the toner 19 is attached to the surface of the heating roller 27*a*, it is removed by the oil pad 30. Such toner 19 is attached to the surface of the oil pad 30 in a solid state. Accordingly, when the heating roller 27*a* is rotated before the surface temperature rises sufficiently, the toner 19 attached to the surface of the oil pad 30 is scrubbed off by the heating roller 27*a* and is attached to the surface of the heating roller 27*a*. Then, when the toner 19 attached to the surface of the heating roller 27*a* reaches the contacting portion, it is also attached to the backup roller 27*b*. The toner 19 attached to the backup roller 27*b* in this way is attached to the back of the paper 16 (on the side of the backup roller 27*b*) when the paper 16 is fed to the fixing section, thus soiling the paper 16.

In the fourth embodiment, however, the heating roller 27*a* is rotated in the opposite direction before making a half revolution as described above, so that the toner 19 attached to the heating roller 27*a* is never attached to the backup roller 27*b*. For this reason, the paper 16 is never soiled by the toner attached to the heating roller 27*a*.

Then, the controller 43 controls the drive circuit 42 in such a way that the heating roller 27*a* repeats reciprocating rotation until the surface temperature detected by the temperature sensor 29 reaches the predetermined set temperature, for example, 130° C. Thereafter, when the surface temperature of the heating roller 27*a* reaches the set temperature, the drive motor is stopped. Thus, rotation of the heating roller 27*a* and the backup roller 27*b* is also stopped, and the starting-up operation is finished.

Since the toner 19 attached to the oil pad 30 is melted when the surface temperature of the heating roller 27*a* reaches the set temperature, it is not to be attached to the heating roller 27*a*.

The outside diameter of the backup roller 27*b* is set to be smaller than that of the heating roller 27*a*. Thus, when the controller 43 controls the drive circuit in such a way that the heating roller 27*a* repeats reciprocating rotation in this way, the surface of the backup roller 27*b* is heated uniformly by the heating roller 27*a* with the repetitive, reciprocating rotation of the heating roller 27*a*. For this reason, a variation on the surface temperature of the backup roller 27*b* is decreased.

Further, since a difference between the surface temperatures of the backup roller 27*b* is reduced, the life of the backup roller 27*b* can be extended.

Moreover, since the heating roller 27*a* and the backup roller 27*b* are rotated at low speeds in the starting-up operation, the durability of the toner image fixing device 27 can be improved.

The present invention is not limited to the embodiments described above. Various modifications which are possible within the scope and spirit of the invention shall not be excluded from it.

What is claimed is:

1. A toner image fixing device in an electrophotographic image forming apparatus comprising:

a heating roller containing a heat generating source;

a backup roller, a surface of which is in contact with a surface of said heating roller, a toner image on a recording medium being fixed by causing the recording medium to pass through a contacting portion of said heating roller and said backup roller;

a driving device for supplying driving power to at least one of said heating roller and said backup roller to rotate both said heating roller and said backup roller; and a controller for controlling said driving device in such a way that both said heating roller and said backup roller begin to rotate intermittently immediately after an electric power supply switch of the electrophotographic image forming apparatus is turned on and heat generation from said heat generating source is initiated, and subsequently rotate continuously.

2. The toner image fixing device according to claim 1, wherein the intermittent rotation of said heating roller and said backup roller is performed in such a way that said backup roller is rotated by a predetermined set angle at intervals of a predetermined set time repeatedly, and the continuous rotation of said heating roller and said backup roller is begun when said backup roller achieves one revolution by the intermittent rotation.

3. The toner image fixing device according to claim 2, wherein the predetermined set time is gradually shortened as said heating roller and said backup roller are intermittently rotated.

4. A toner image fixing device in an electrophotographic image forming apparatus comprising:

a heating roller containing a heat generating source;

a backup roller, a surface of which is in contact with a surface of said heating roller, a toner image on a recording medium being fixed by causing the recording medium to pass through a contacting portion of said heating roller and said backup roller;

a driving device for supplying driving power to at least one of said heating roller and said backup roller to rotate both said heating roller and said backup roller; and a controller for controlling said driving device in such a way that both said heating roller and said backup roller repeat reciprocating rotation intermittently immediately after an electric power supply switch of the electrophotographic image forming apparatus is turned on and heat generation from said heat generating source is initiated.

5. The toner image fixing device according to claim 4, further comprising a temperature sensor for detecting a surface temperature of said heating roller;

wherein the reciprocating rotation of said heating roller and said backup roller is performed in such a way that said heating roller repeats reciprocating rotation by a predetermined set angle which is equal to or less than half revolution until the surface temperature detected by said temperature sensor reaches a predetermined set temperature during the reciprocating rotation of said heating roller and said backup roller.

6. The toner image fixing device according to claim 4, wherein an outside diameter of said backup roller is smaller than an outside diameter of said heating roller.

7. A toner image fixing device in an electrophotographic image forming apparatus comprising:

a heating roller containing a heat generating source;

a backup roller, a surface of which is in contact with a surface of said heating roller, a toner image on a recording medium being fixed by causing the recording medium to pass through a contacting portion of said heating roller and said backup roller;

a driving device for supplying driving power to at least one of said heating roller and said backup roller to rotate both said heating roller and said backup roller; and a controller for controlling said driving device in such away that both said heating roller and said backup roller begin to rotate continuously immediately after an electric power supply switch of the electrophotographic image forming apparatus is turned on and heat generation from said heat generating source is initiated;

wherein a rotation speed of said heating roller and said backup roller is gradually and continuously increased, and subsequently reaches a predetermined constant speed.

8. The toner image fixing device according to claim 7, wherein the rotation at the predetermined constant speed is begun when said backup roller achieves one revolution.

* * * * *